US009737893B2

(12) United States Patent
Huang et al.

(10) Patent No.: US 9,737,893 B2
(45) Date of Patent: Aug. 22, 2017

(54) HOLDING APPARATUS OF A MICROFLUIDIC DEVICE

(71) Applicant: Abnova (Taiwan) Corporation, Taipei (TW)

(72) Inventors: Wilber Huang, Taipei (TW); Hann-Wen Guan, Taipei (TW)

(73) Assignee: Abnova (Taiwan) Corporation, Taipei (TW)

( * ) Notice: Subject to any disclaimer, the term of this patent is extended or adjusted under 35 U.S.C. 154(b) by 0 days.

(21) Appl. No.: 15/174,987

(22) Filed: Jun. 6, 2016

(65) Prior Publication Data

US 2016/0367993 A1 Dec. 22, 2016

(30) Foreign Application Priority Data

Jun. 16, 2015 (TW) ..... 104119386 A

(51) Int. Cl.
*B01L 9/00* (2006.01)
*B01L 3/00* (2006.01)

(52) U.S. Cl.
CPC ..... *B01L 9/527* (2013.01); *B01L 3/502715* (2013.01); *B01L 2200/021* (2013.01); *B01L 2200/025* (2013.01); *B01L 2200/027* (2013.01); *B01L 2200/148* (2013.01); *B01L 2300/043* (2013.01); *B01L 2300/047* (2013.01); *B01L 2300/123* (2013.01)

(58) Field of Classification Search
CPC .. B01L 3/502715; B01L 3/5027; B01L 3/502; B01L 3/50; B01L 9/527; B01L 9/52
USPC ..... 422/503, 502, 500, 50
See application file for complete search history.

(56) References Cited

U.S. PATENT DOCUMENTS 5,100,626 A * 3/1992 Levin ..... G01N 33/54366 422/420
2004/0037739 A1* 2/2004 McNeely ..... B01F 5/10 422/417
2004/0228771 A1* 11/2004 Zhou ..... B01L 9/527 422/503

* cited by examiner

*Primary Examiner* — Christine T Mui
(74) *Attorney, Agent, or Firm* — Winston Hsu

(57) ABSTRACT

A holding apparatus includes a top holder having a coupler and a top casing capable of adjusting the distance and tilt therebetween using three points adjustment. When a microfluidic device along with a cover are disposed on a bottom holder of the holding apparatus and the top holder is pivoted with respect to the bottom holder to a closed position, the contact surface of soft plugs on the coupler and the cover can be made parallel by a certain distance with a first surface of the microfluidic device, and the distance between the coupler and the top casing determines the pressure exerted through elastic components onto the microfluidic device, so that external pipes can be seamlessly attached to the microfluidic device and also ensuring no deformation due to external forces should happen on microfluidic device.

9 Claims, 9 Drawing Sheets

HOLDING APPARATUS OF A MICROFLUIDIC DEVICE

CROSS REFERENCE TO RELATED DOCUMENT

This application claims priority to Taiwanese Patent Application No. 104119386, filed on Jun. 16, 2015.

BACKGROUND OF THE INVENTION

1. Field of the Invention

The invention relates to a holding apparatus, and more particularly, to a holding apparatus applied for holding a microfluidic device.

2. Description of the Prior Art

The advancement of micro electro mechanical system (MEMS) technology has brought various kinds of microfluidic devices into presence. In biological test, microfluidic devices made of poly-dimethylsiloxane (PDMS) platform and substrate, where biological detection materials such as antibody or nano gold are placed, allow cell-size objects to pass through so as to perform processing, reacting, or analyzing detection of the fluidic samples.

However, such micrometer-scale microfluidic platform has a high requirement for the test environment. If the microfluidic device is placed out of level or the clamping force is not uniformly exerted on the microfluidic device, fluids in each passway may have different flow rate, not to mention the clogging. For example, manual needle insertion is common in the practice of prior art, which directly inserts a needle-like metal or plastic inlet tube and outlet tube into the inlet and the outlet of the microfluidic device, the surface friction and interference between the tubes and the inlet/outlet of the microfluidic device are the key factors that ensure the attachment and no leaking of fluid should happen. However, doing the insertion and maintaining the tubes at where they should be in a manual way has poor reliability and is apt to loose the inlet tube or the outlet tube. It is also unable to keep perfect seal between tubes and the inlet/outlet of the microfluidic device, or even clogging caused by the deformation of the microfluidic device could happen due to excessive exertion of force onto a part of a chip on microfluidic device.

Adhesion is also available in the market to combine the inlet tube and the outlet tube with the inlet/outlet of the microfluidic device, which also takes a great deal of preparation and problem of controlling the contact pressure of the inlet and the outlet exists.

It is therefore an important issue to keep the level of the microfluidic device and exert even and proper clamping force thereto so that external pipes can be seamlessly attached to the microfluidic device with sufficient connection pressure between the tubes and the inlet/outlet and no deformation due to external forces should happen on microfluidic device.

SUMMARY OF THE INVENTION

In view of the above problem, a holding apparatus of a microfluidic device is provided in the invention that can establish an import channel and an export channel toward the microfluidic device in a fast and convenient way when replacement of microfluidic device takes place.

Embodiments in the invention provide a holding apparatus of a microfluidic device having a first surface. The holding apparatus includes a bottom holder and a top holder.

The microfluidic device is disposed on the bottom holder in a replaceable way. The top holder is pivoted to the bottom holder and is configurable at an opened position or a closed position with respect to the bottom holder. The top holder includes a top casing and a coupler. The top casing is placed in parallel with the bottom holder when the top holder is configured at the closed position with respect to the bottom holder. The coupler includes a second surface facing the microfluidic device. The coupler is assembled to the top casing wherein three adjusting screws are disposed between the coupler and the top casing so that distance between the coupler and the top casing is made adjustable. A parallel relation and a specific distance between the second surface of the coupler and the first surface of the microfluidic device are provided by the holding apparatus via adjusting the three adjusting screws to determine a distance and a tilting angle of the coupler with respect to the top casing.

Regarding the embodiments of the invention, the coupler includes two soft plugs and the holding apparatus further includes a cover assembled with the microfluidic device. When the top holder is configured at the closed position with respect to the bottom holder, the two soft plugs are abutting against the cover and the second surface includes the two soft plugs' abutting surfaces.

Regarding the embodiments of the invention, the microfluidic device includes an inlet and an outlet, and when the cover and the microfluidic device are disposed on the bottom holder and the top holder is configured at the closed position, the cover and the two soft plugs provide an import channel and an export channel for the microfluidic device where the import channel connects the inlet and the export channel connects the outlet.

Regarding the embodiments of the invention, the microfluidic device includes a substrate and a poly-dimethylsiloxane (PDMS) platform, the first surface is located at the substrate and the PDMS platform is disposed on the first surface, and the inlet and the outlet are located at the PDMS platform. The cover includes a first channel which is connected to the inlet and a second channel which is connected to the outlet.

Regarding the embodiments of the invention, the first channel includes a first abutting surface and the second channel includes a second abutting surface, and the two soft plugs abut against the first abutting surface and the second abutting surface respectively.

Regarding the embodiments of the invention, the cover includes two supportive pillars extending toward the substrate and the two supportive pillars abut against the first surface so that the cover is assembled with the first surface of the microfluidic device.

Regarding the embodiments of the invention, the first channel of the cover includes a first vessel and the second channel of the cover includes a second vessel. When the two supportive pillars abut against the first surface, the first vessel extends within the inlet and the second vessel extends within the outlet.

Regarding the embodiments of the invention, the holding apparatus further includes an adjusting fixture, whose shape and size are the same as the shape and size of the assembled cover and microfluidic device. The adjusting fixture is disposed on the bottom holder in a replaceable way so that the parallel relation between the second surface of the coupler and the first surface can be provided by the holding apparatus via adjusting the three adjusting screws to determine the distance and the tilting angle of the coupler with respect to the adjusting fixture.

Regarding the embodiments of the invention, the two soft plugs are made of rubber or plastic with elastic deformability.

The import channel and the export channel can be established in a fast and accurate way by using the holding apparatus of the invention. External pipes can be seamlessly attached to the microfluidic device with sufficient connection pressure between the tubes and the inlet/outlet and no deformation due to external forces should happen on microfluidic device. Replacement of microfluidic devices for test or experiment is therefore quick and convenient.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. In the following discussion and in the claims, the terms "include" and "comprise" are used in an open-ended fashion. Also, the term "couple" is intended to mean either an indirect or direct electrical/mechanical connection. Thus, if a first device is coupled to a second device, that connection may be through a direct electrical/mechanical connection, or through an indirect electrical/mechanical connection via other devices and connections.

Figure 1:
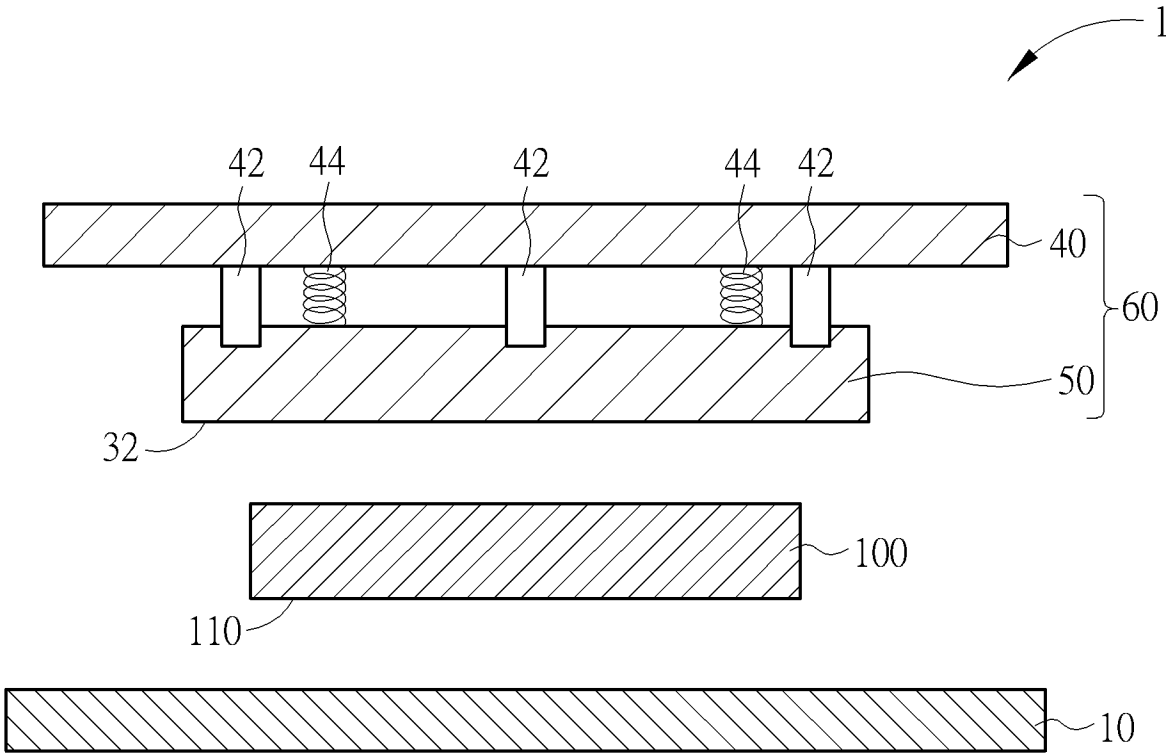
FIG. 1 is a component block diagram of a holding apparatus according to an embodiment of the invention.

Please refer to FIG. 1. FIG. 1 is a component block diagram of a holding apparatus according to an embodiment of the invention. The holding apparatus 1 includes a bottom holder 10 and a top holder 60. The top holder 60 includes a top casing 40 and a coupler 50. The top holder 60 is pivoted to the bottom holder 10 and can be pivoted to open or to close. When the top holder 60 is closed with respect to the bottom holder 10, the top casing 40 of the top holder 60 is made parallel with the bottom holder 10. The coupler 50 is assembled to the top casing 40 via a plurality of elastic components 44 and at least three adjusting screws 42 are disposed between the coupler 50 and the top casing 40. The adjusting screws 42 are utilized to adjust distances at three positions of the coupler 50 to the top casing 40 respectively so that a parallel relation and the distance between a second surface 32 of the coupler 50 and the top casing 40 can be adjusted and provided. When the bottom holder 10 of the holding apparatus 1 is holding a microfluidic device 100, the second surface 32 of the coupler 50 can be adjusted to be in parallel with a first surface 110 of the microfluidic device 100 so as to maintain a specific parallel distance with the microfluidic device 100.

Figure 2:
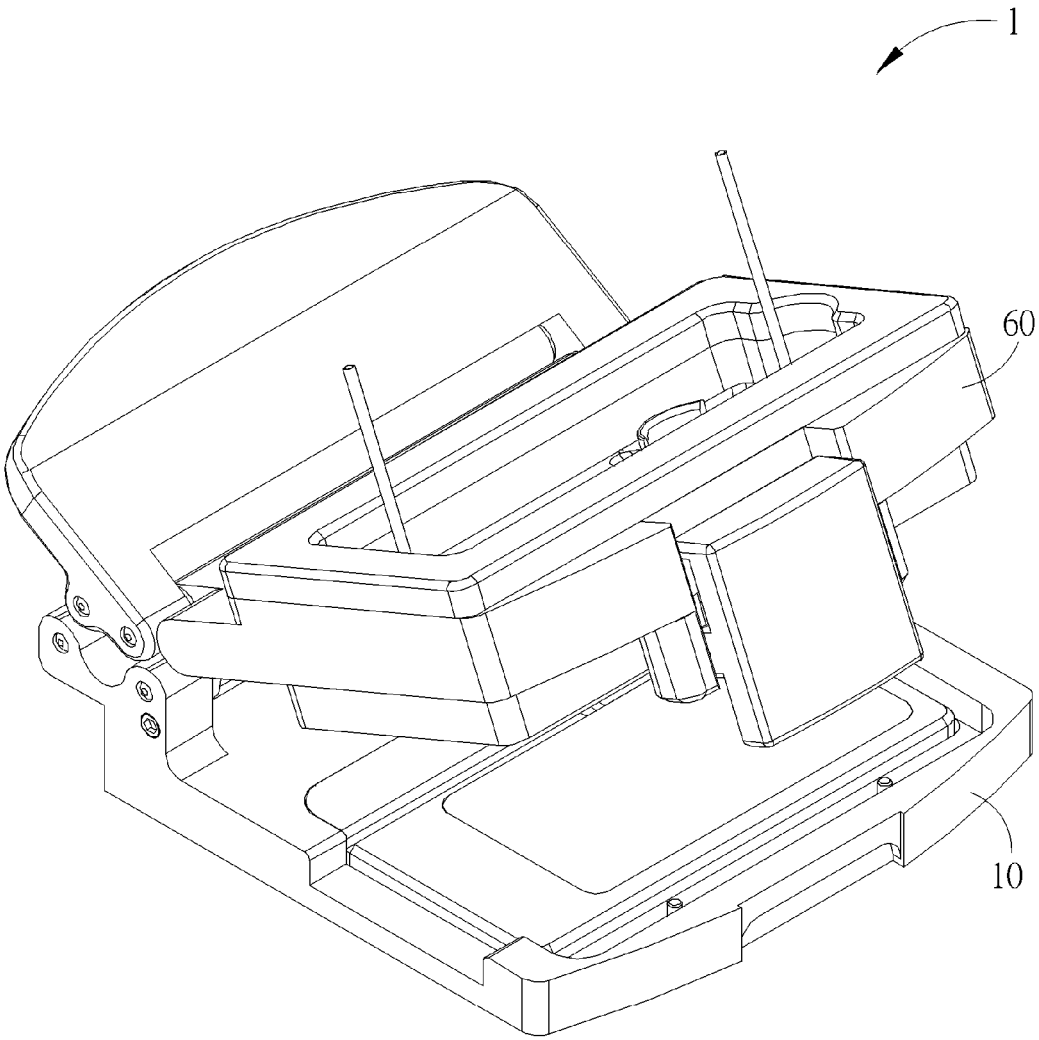
FIG. 2 is an illustration of an embodiment of the holding apparatus in an opened position according to the invention.
Figure 3:
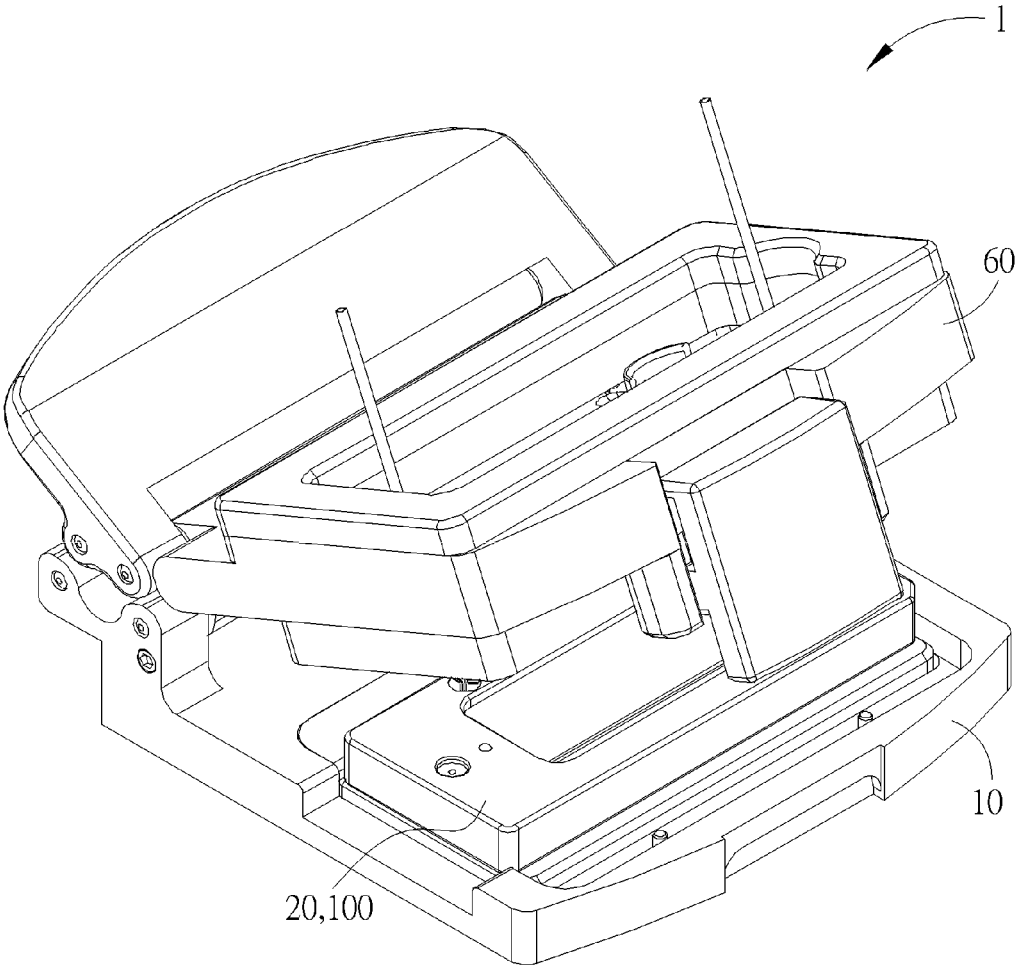
FIG. 3 is an illustration showing placement of a microfluidic device in the opened holding apparatus in FIG. 2.

Please refer to FIG. 2 and FIG. 3. FIG. 2 is an illustration of an embodiment of the holding apparatus in an opened position according to the invention and FIG. 3 is an illustration showing placement of a microfluidic device in the opened holding apparatus in FIG. 2. In a preferred embodiment according to the invention, the holding apparatus 1 can be used for holding the microfluidic device 100 and performing processing, reacting, analyzing, or testing of fluidic samples thereon. The top holder 60 of the holding apparatus 1 provides an import channel and an export channel for the microfluidic device 100, which is further described later, and provides a parallel relation with the bottom holder 10. When the top holder 60 is opened with respect to the bottom holder 10 as shown in FIG. 2, the microfluidic device 100, which is already assembled with a cover 20 of the holding apparatus 1, can be placed on the bottom holder 10 as shown in FIG. 3 and the microfluidic device 100 can be provided with proper and even pressure from the import channel and the export channel of the holding apparatus 1 upon the inlet and the outlet when the top holder 60 is closed.

Figure 4:
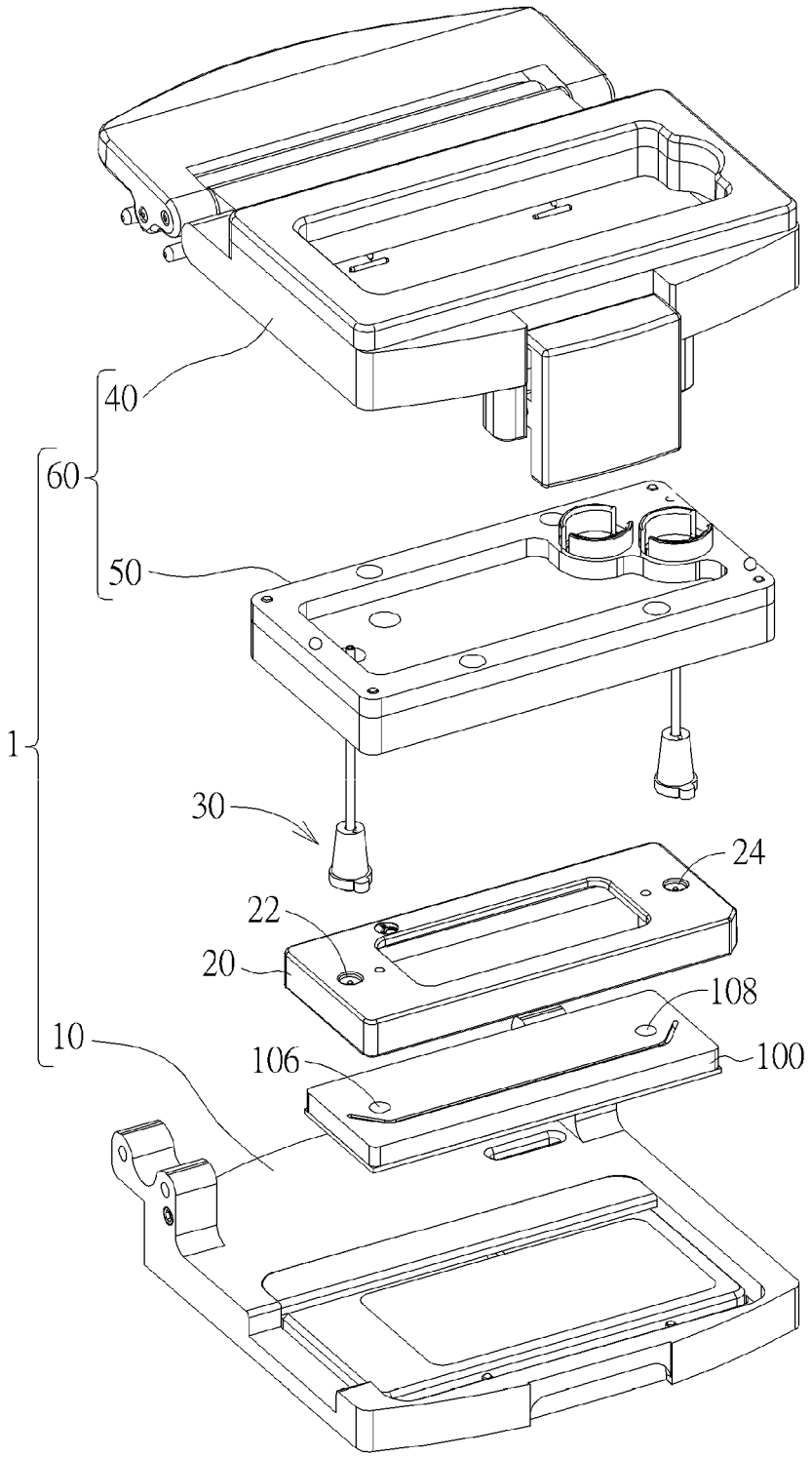
FIG. 4 is an illustration of an exploded view of the components of the holding apparatus along with the microfluidic device of FIG. 2.
Figure 9:
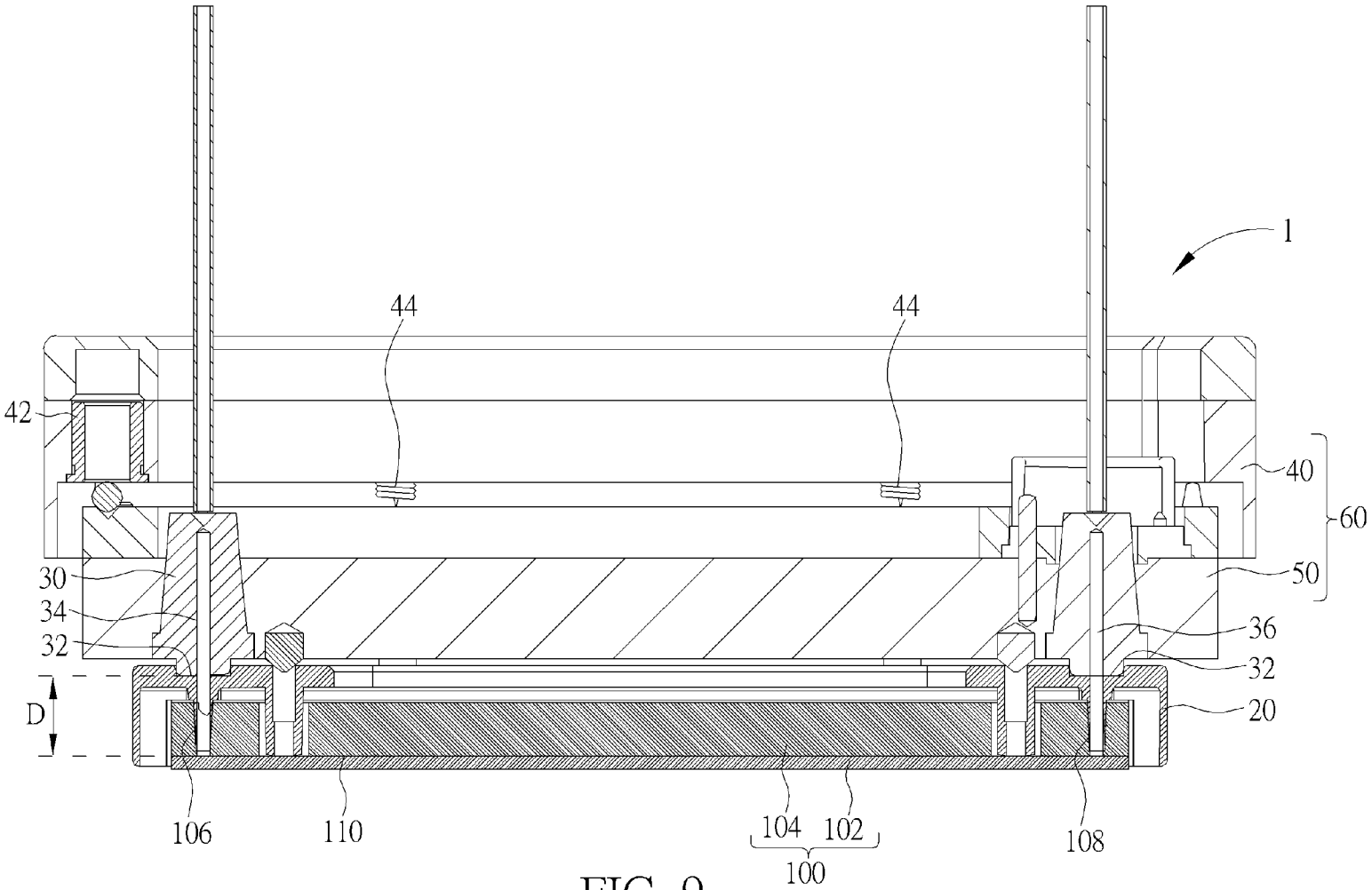
FIG. 9 is an illustration of cross sectional view of the holding apparatus in the hold of the microfluidic device.

Please refer to FIG. 4. FIG. 4 is an illustration of an exploded view of the components of the holding apparatus along with the microfluidic device of FIG. 2. As described earlier, the holding apparatus 1 includes the top holder 60 and the bottom holder 10. The top holder 60 is pivoted to the bottom holder 10 and can be configured with respect to the bottom holder 10 at an opened position as shown in FIG. 2 and FIG. 3 or at a closed position as shown in FIG. 9. The bottom holder 10 is utilized for holding the microfluidic device 100 where the microfluidic device 100 is disposed on the bottom holder 10 in a replaceable way. The holding apparatus 1 further includes a cover 20, which is to be assembled with the microfluidic device 100 as an integral part to be disposed on the bottom holder 10. The coupler 50 includes two soft plugs 30, preferably made of rubber or plastic with elastic deformability. The microfluidic device 100 has an inlet 106 and an outlet 108 and the cover 20 that is assembled with the microfluidic device 100 has a first channel 22 and a second channel 24, respectively correspondingly connecting to the inlet 106 and the outlet 108 of the microfluidic device 100. The holding apparatus 1 provides an import channel and an export channel for the microfluidic device 100 by using the two soft plugs 30 and the first channel 22 and the second channel 24 of the cover 20. When the cover 20 and the microfluidic device 100 are disposed on the bottom holder 10 and the top holder 60 is configured at the closed position, the import channel can be connected to the inlet 106 and the export channel can be connected to the outlet 108.

Figure 5:
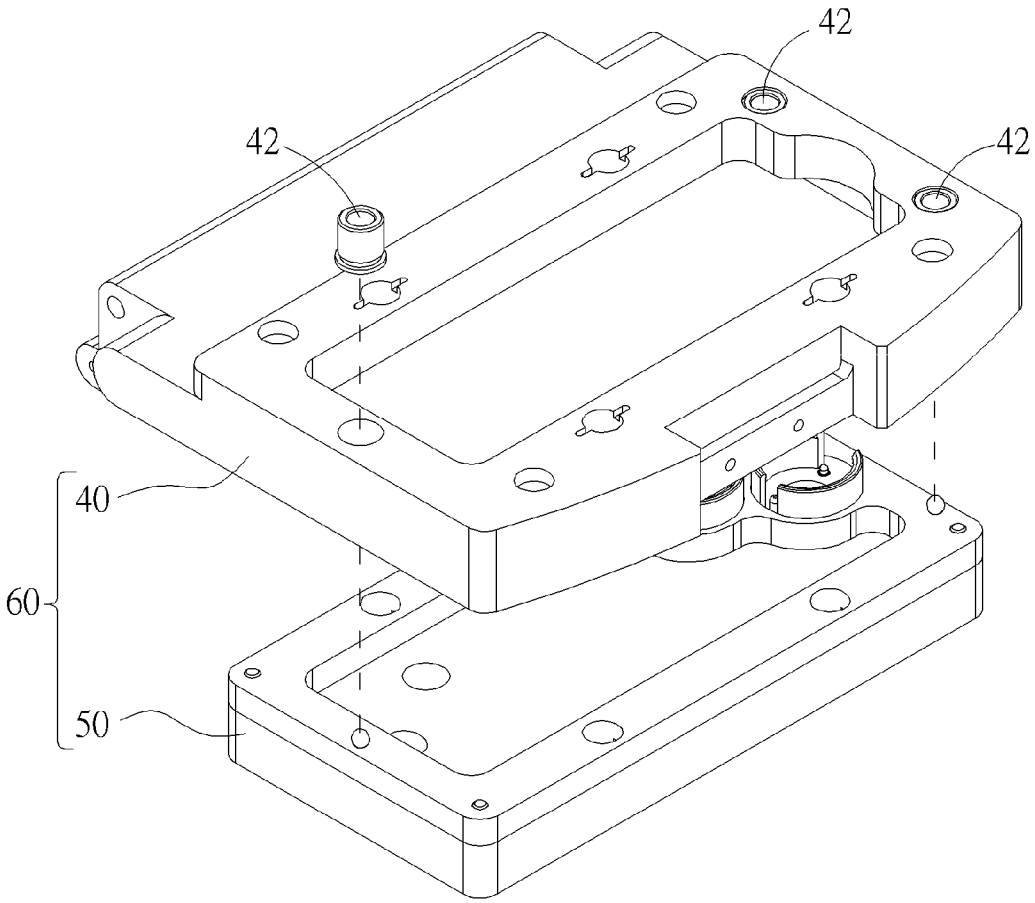
FIG. 5 is an illustration of the top holder of the holding apparatus.

Please refer to FIG. 5, which is an illustration of the top holder of the holding apparatus. In FIG. 5, the coupler 50 of the top holder 60 can be adjusted via three adjusting screws 42 to be specifically distanced and have certain tilting angle with respect to the top casing 40. The three adjusting screws 42 are disposed within the top casing 40 and respectively abut against three different and non-collinear positions of a surface of the coupler 50 that faces the top casing 40. When one adjusting screw 42 is rotated, the position of the coupler 50 corresponding to the adjusting screw 42 can be pushed away from the top casing 40, or be pulled back close to the top casing 40 by the elastic components 44, the elastic components 44 shown in FIG. 1 or FIG. 9. As the three adjusting screws 42 can be adjusted separately, the distance and the tilting angle of the coupler 50 with respect to the top casing 40 can be altered and through this way, the coupler 50 can be tuned to have a parallel relation with the top casing 40.

Figure 6:
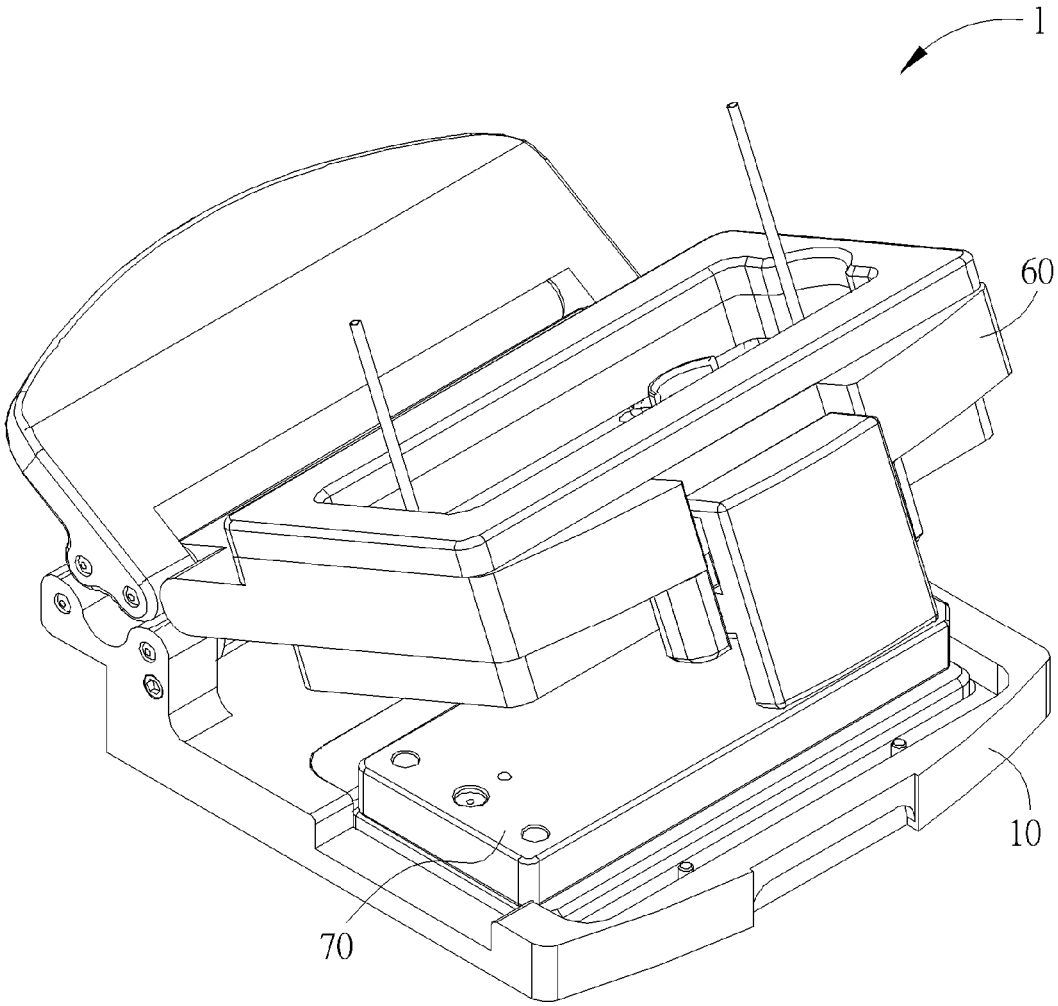
FIG. 6 is an illustration showing using an adjusting fixture for level and pressure calibration of the holding apparatus.

Please refer to FIG. 6. FIG. 6 is an illustration showing using an adjusting fixture for level and pressure calibration of the holding apparatus. The holding apparatus 1 further includes an adjusting fixture 70, whose shape and size are the same as the shape and size of the assembled cover 20 and microfluidic device 100. In one embodiment, the adjusting fixture 70 can be made of aluminum but should not be regarded as a limitation. Given the fact that the abutting points of three adjusting screws 42 decide a plane on the coupler 50, for one embodiment, the adjusting fixture 70 can be used as an adjustment tool before the microfluidic device 100 is actually placed in the holding apparatus 1. As shown in FIG. 6, after the adjusting fixture 70 is placed on the bottom holder 10, a couple drips of colored reagents can be placed on the adjusting fixture 70, the bottom central area of the coupler 50 being a transparent visible plane, and when the top holder 60 is configured at the closed position with respect to the bottom holder 10 as shown in FIG. 9, the colored reagents between the coupler 50 and the adjusting fixture 70 will be flattened by the coupler 50 and the adjusting fixture 70 to produce round flat shape with different size. Adjusting the adjusting screws 42 to change the height at different positions of the couples 50 until each colored reagent shows approximately the same size comes to a result that adjustment of the parallel relation between the coupler 50 and the top casing 40 (and the adjusting fixture 70) is done. However, there can be more than what is described here to carry out the adjustment of parallel relation between the coupler 50 and the top casing 40 such as optical adjustment or other type of three-point or multi-point distance adjustment, which should not be construed as a limitation of the invention.

Figure 7:
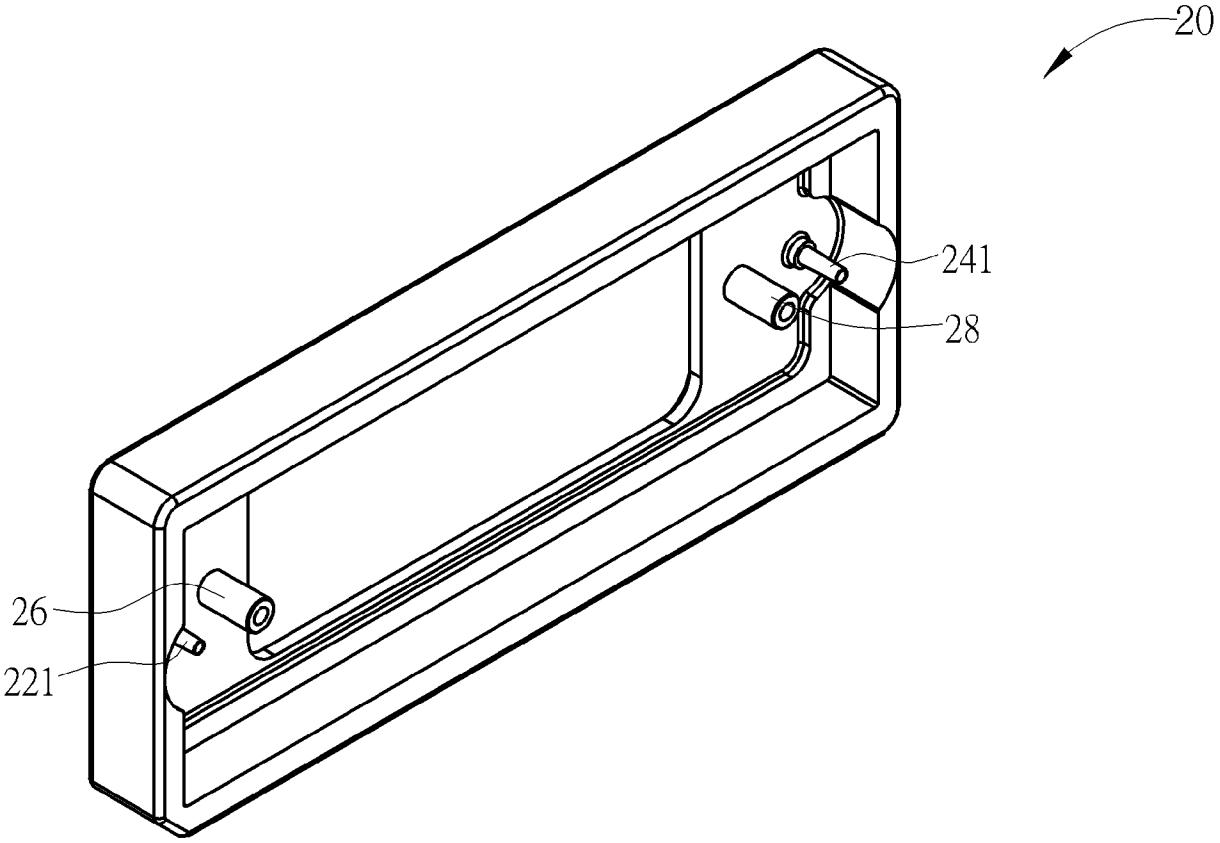
FIG. 7 is an illustration of the cover of the holding apparatus.
Figure 8:
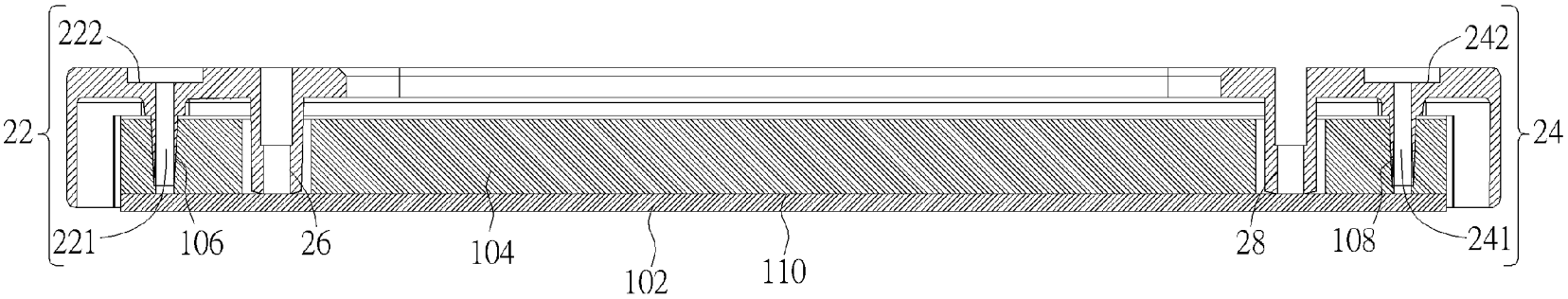
FIG. 8 is an illustration showing cross sectional view of the microfluidic device assembled with the cover of FIG. 7.

Please refer to FIG. 7 and FIG. 8. FIG. 7 is an illustration of the cover of the holding apparatus and FIG. 8 is an illustration showing cross sectional view of the microfluidic device assembled with the cover of FIG. 7. The microfluidic device 100 includes a substrate 102 and a poly-dimethylsiloxane (PDMS) platform 104. The substrate 102 is a hard object where the first surface 110 is located. The soft PDMS platform 104 is disposed on the first surface 110. The inlet 106 and the outlet 108 of the microfluidic device 100 are located at the PDMS platform 104. As described earlier, the cover 20 and the microfluidic device 100 are assembled as an integral part. In FIG. 7, the cover 20 has two supportive pillars 26, 28 extending toward the substrate 102. The two supportive pillars 26, 28 abut against the first surface 110 of the substrate 102 so that the cover 20 is assembled with the first surface 110 of the microfluidic device 100. Please refer to FIG. 7 and FIG. 4 for another perspective view of the cover 20. The first channel 22 of the cover 20 has a first vessel 221 in the face of the inlet 106 and the second channel 24 has a second vessel 241 in the face of the outlet 108. When the two supportive pillars 26, 28 abut against the first surface 110, the first vessel 221 extends within the inlet 106 and the second vessel 241 extends within the outlet 108. Additionally, the first channel 22 of the cover 20 has a first abutting surface 222 at the side opposite to the first vessel 221 and the second channel 24 has a second abutting surface 242 at the side opposite to the second vessel 241 (referring to FIG. 8).

Please refer to FIG. 9, which is an illustration of cross sectional view of the holding apparatus in the hold of the microfluidic device. Once the microfluidic device 100 and the cover 20 are placed on the bottom holder 10 of the holding apparatus 1, and the top holder 60 is configured at the closed position as shown in FIG. 9, the two soft plugs 30 of the top holder 60 will abut against the first abutting surface 222 and the second abutting surface 242 of the cover 20 in which the second surface 32 of the coupler 50 includes the two soft plugs 30' abutting surfaces against the cover 20. The two soft plugs 30 along with the first channel 22 and second channel 24 (referring to FIG. 8) jointly provide an import channel 34 in connection to the inlet 106 of the microfluidic device 100 and an export channel 36 in connection to the outlet 108.

As described, using the adjusting fixture 70 in FIG. 6 to watch the distribution of colored liquid on the first abutting surface 222 and/or the second abutting surface 242 (the adjusting fixture 70 can also be made of transparent material and also have structure like the first abutting surface 222 and the second abutting surface 242 of the cover 20) and adjusting the parallel relation and the distance between the coupler 50 and the top casing 40 by use of the adjusting screws 42, the parallel relation and a specific distance D can be set and provided between the second surface 32 and the first surface 110. It is therefore convenient to determine a proper pressure exerted by the soft plugs 30 of the coupler 50 unto the abutting surfaces of the cover 20 before the pressure gets excessive and by adjusting the parallel relation between the coupler 50 and the top casing 40 (since the top casing 40 is designed to be in parallel with the bottom holder 10 and the microfluidic device 100 when the top holder 60 is configured at the closed position with respect to the bottom holder 10), the two soft plugs 30 get to abut against the cover 20 evenly, where the cover 20 takes turn to abut against the microfluidic device 100, so as to ensure even force exerted on the microfluidic device 100. It should be noted that the cover 20 is a hard part while the PDMS platform 104 and the soft plugs 30 are made of soft material, in comparison with the cover 20. The holding apparatus 1 of the invention provides a soft-hard-soft linking relation among the soft plugs 30, the cover 20, and the PDMS platform 104, which effectively provides sealing for the import channel 34 and the export channel 36.

The holding apparatus provided in the invention including the top holder having the coupler and the top casing capable of adjusting the distance and tilt angle therebetween using three points adjustment. When the microfluidic device along with the cover are disposed on the bottom holder of the holding apparatus and the top holder is pivoted with respect to the bottom holder to the closed position, the contact surface of soft plugs on the coupler and the cover can be made parallel by a certain distance with the first surface of the microfluidic device, and the distance between the coupler and the top casing determines the pressure exerted through elastic components onto the microfluidic device. The import channel and the export channel can be established in a fast and accurate way by using the holding apparatus of the invention. External pipes can be seamlessly attached to the microfluidic device with sufficient connection pressure between the channels and the inlet/outlet and no deformation due to external forces should happen on microfluidic device. Replacement of microfluidic devices for test or experiment is therefore quick and convenient.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A holding apparatus of a microfluidic device having a first surface, the holding apparatus comprising:

a bottom holder, where the microfluidic device is disposed on the bottom holder in a replaceable way; and a top holder, pivoted to the bottom holder and configurable at an opened position or a closed position with respect to the bottom holder, the top holder comprising:

a top casing, placed in parallel with the bottom holder when the top holder is configured at the closed position with respect to the bottom holder; and a coupler comprising a second surface facing the microfluidic device, the coupler assembled to the top casing wherein three adjusting screws are disposed between the coupler and the top casing so that distance between the coupler and the top casing is made adjustable;

wherein a parallel relation and a specific distance between the second surface of the coupler and the first surface of the microfluidic device are provided by the holding apparatus via adjusting the three adjusting screws to determine a distance and a tilting angle of the coupler with respect to the top casing.

2. The holding apparatus of claim 1, wherein the coupler comprises two soft plugs and the holding apparatus further comprises a cover assembled with the microfluidic device, wherein when the top holder is configured at the closed position with respect to the bottom holder, the two soft plugs are abutting against the cover and the second surface includes the two soft plugs' abutting surfaces.

3. The holding apparatus of claim 2, wherein the microfluidic device comprises an inlet and an outlet, and when the cover and the microfluidic device are disposed on the bottom holder and the top holder is configured at the closed position, the cover and the two soft plugs provide an import channel and an export channel for the microfluidic device where the import channel connects the inlet and the export channel connects the outlet.

4. The holding apparatus of claim 3, wherein the microfluidic device comprises a substrate and a poly-dimethylsiloxane (PDMS) platform, the first surface is located at the substrate and the PDMS platform is disposed on the first surface, and the inlet and the outlet are located at the PDMS platform, the cover comprising:

a first channel which is connected to the inlet; and a second channel which is connected to the outlet.

5. The holding apparatus of claim 4, wherein the first channel comprises a first abutting surface and the second channel comprises a second abutting surface, and the two soft plugs abut against the first abutting surface and the second abutting surface respectively.

6. The holding apparatus of claim 4, wherein the cover comprises two supportive pillars extending toward the substrate, and the two supportive pillars abut against the first surface so that the cover is assembled with the first surface of the microfluidic device.

7. The holding apparatus of claim 6, wherein the first channel of the cover comprises a first vessel and the second channel of the cover comprises a second vessel; wherein when the two supportive pillars abut against the first surface, the first vessel extends within the inlet and the second vessel extends within the outlet.

8. The holding apparatus of claim 2, further comprising an adjusting fixture, whose shape and size are the same as the shape and size of the assembled cover and microfluidic device, the adjusting fixture being disposed on the bottom holder in a replaceable way so that the parallel relation between the second surface of the coupler and the first surface can be provided by the holding apparatus via adjusting the three adjusting screws to determine the distance and the tilting angle of the coupler with respect to the adjusting fixture.

9. The holding apparatus of claim 2, wherein the two soft plugs are made of rubber or plastic with elastic deformability.

* * * * *